United States Patent [19]

Judkins

[11] Patent Number: 4,673,018

[45] Date of Patent: Jun. 16, 1987

[54] SUN BLIND

[75] Inventor: Ren S. Judkins, Salt Lake City, Utah

[73] Assignee: Verosol USA Inc., Pittsburgh, Pa.

[21] Appl. No.: 670,813

[22] Filed: Nov. 13, 1984

[51] Int. Cl.[4] ..... E06B 9/327; E06B 9/30

[52] U.S. Cl. ..... 160/84 R; 160/168 R

[58] Field of Search ..... 160/169, 168 R, 168 A, 160/84 R, 279, 174; 24/115 R

[56] References Cited

U.S. PATENT DOCUMENTS

| | | | |
|---|---|---|---|
| 1,794,501 | 3/1931 | Russell | 160/168 |
| 2,083,881 | 3/1937 | Wade | 160/168 X |
| 2,247,260 | 6/1941 | Stone | 160/168 |
| 3,129,750 | 4/1964 | Brandin | 160/168 |
| 3,719,221 | 3/1973 | Hanson | 160/107 |
| 4,202,395 | 5/1980 | Heck | 160/279 |
| 4,473,101 | 9/1984 | Langeler | 160/84 R |
| 4,518,025 | 5/1985 | Judkins | 160/84 R |
| 4,526,428 | 7/1985 | Sachs | 24/115 R |

FOREIGN PATENT DOCUMENTS

| | | | |
|---|---|---|---|
| 1298478 | 6/1962 | France | 160/168 |

*Primary Examiner*—Ramon S. Britts

*Assistant Examiner*—Cherney S. Lieberman

*Attorney, Agent, or Firm*—Kenyon & Kenyon

[57] ABSTRACT

A sun blind for a window opening is disclosed. The sun blind comprises a first rail disposed adjacent the top of the window opening, a second rail disposed adjacent the bottom of the opening, a third moving rail disposed between the first and second rails, a sun blinding member attached to the first and third rails, a first cord arrangement disposed adjacent a side of the window opening, a second cord arrngement partially disposed adjacent the first cord arrangement and also through a plurality of aligned openings in the sun blinding member for raising and lowering the third rail and a coupler connecting the first and second cord arrangements together. The coupler comprises first and second plates between which are clamped the cords of the second cord arrangement. The ends of the cords of the first cord arrangement are coupled to one of the plates. A tension lock is provided for applying tension to the second cord arrangement and preferably a third cord arrangement is provided for guiding the sun blinding member and a fourth cord arrangement is provided for guiding the coupler.

34 Claims, 34 Drawing Figures

Fig. 6.
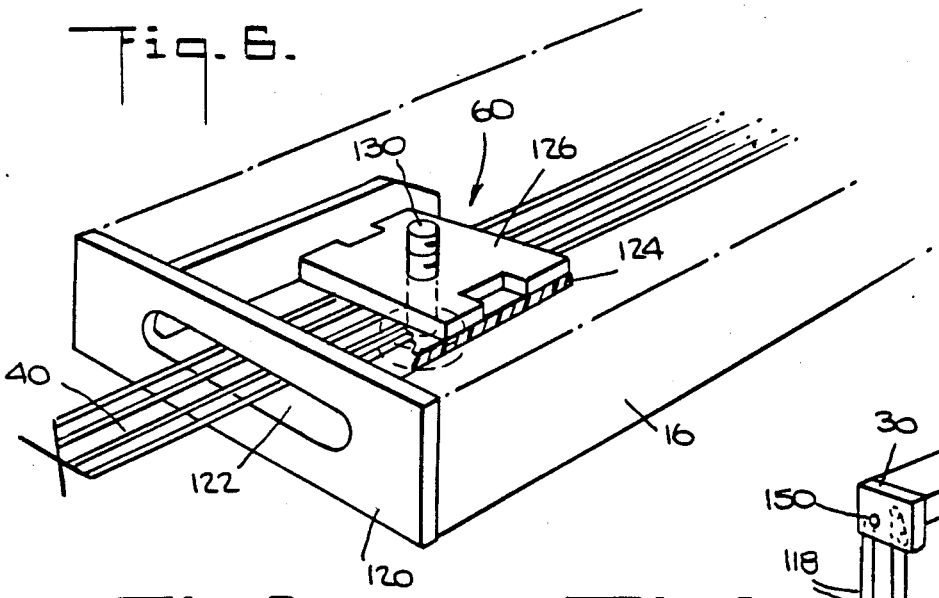
Fig. 7.
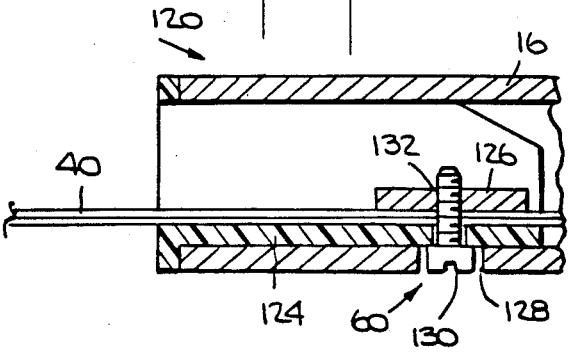
Fig. 8.
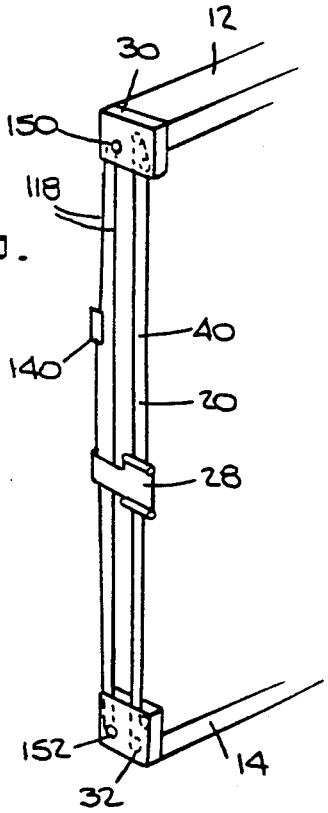
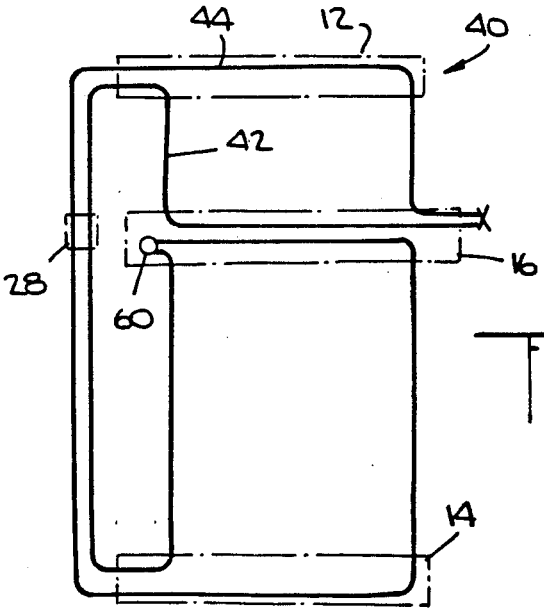
Fig. 2D.
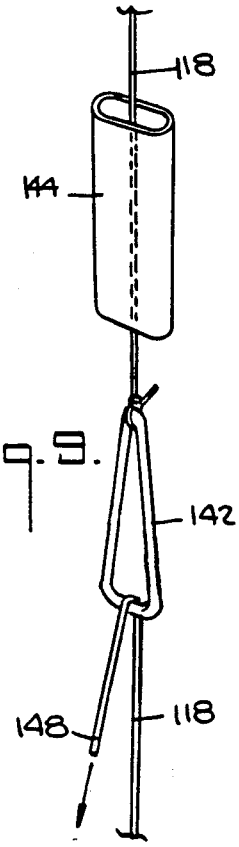
Fig. 9.
Fig. 10.
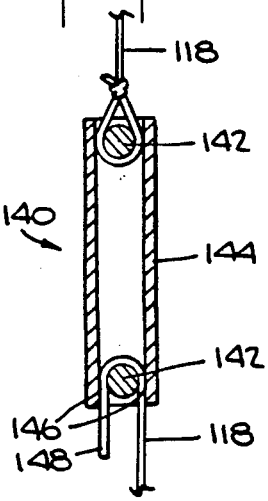

SUN BLIND

BACKGROUND OF THE INVENTION

The present invention relates to the field of sun blinds, and particularly to a sun blind having a plurality of cord arrangements for operating, guiding and moving the sun blinding member. More particularly, the present invention relates to a sun blind having a coupling member for coupling a first cord arrangement which is operated by a user to a second cord arrangement which raises and lowers the sun blind. The sun blind according to the present invention is especially useful in applications where the opening or window in which the sun blind is to be disposed is out-of-square. Furthermore, the sun blind according to the present invention can be used in a variety of window opening orientations and provides a variety of operating options.

SUMMARY OF THE INVENTION

It is an object of the present invention to provide a sun blind having separate cord arrangements for operation by an operator, for raising and lowering the sun blinding member and for guiding the sun blinding member.

It is also an object of the present invention to provide a sun blind having a unique coupling arrangement for coupling a separate user or motor operated cord arrangement to another cord arrangement which is connected to the sun blinding member and which raises and lowers the sun blinding member.

It is a further object of the present invention to provide a sun blind which can be used in out of square window openings.

It is still a further object of the present invention to provide a sun blind which can be conveniently installed in a window opening.

It is yet another object of the present invention to provide a sun blind having tension applying members which allow convenient adjustment of the cord arrangements during installation so as to accommodate different window openings.

It is still another object of the present invention to provide a sun blind which is marked by ease of production.

It is still yet another object of the present invention to provide a sun blind having a cord arrangement which is free from cord twisting once installed.

It is still yet a further object of the present invention to provide a sun blind which is easy to operate and which requires minimal effort to operate.

It is yet a further object of the present invention to provide a sun blind which is not limited to one mode of operation, i.e., a sun blind which can be operated in a number of ways, including, but not limited to, straight cord pull, loop cord pull, hand push, wand pull or by motor. It is furthermore an object of the present invention to provide such a sun blind which can easily and conveniently be changed from one mode of operation to another, even in the home.

It is still another object to provide a sun blind which can be utilized in window openings having any orientation, i.e., one which can be hung in any plane, which will operate in any direction and which is independent of gravitational effects.

These and other objects of the present invention are achieved by a sun blind for a window opening comprising first rail means disposed adjacent the top of the opening, second rail means disposed adjacent the bottom of the opening, third rail means disposed between the first and second rail means, the third rail means being movable between the first and second rail means, sun blinding means disposed between the first and third rail means and attached to the first and third rail means, the sun blinding means having a plurality of aligned apertures disposed therein, first cord means disposed adjacent a side of the opening and being operable by an operator, second cord means at least partially disposed adjacent the first cord means and further being disposed in the plurality of aligned openings in the sun blinding means for raising and lowering the third rail means, means disposed on the first cord means adjacent the side of the window for coupling the first cord means to the second cord means, the coupling means including first and second plate means and means for releasably fastening the first plate means to the second plate means, the second cord means being disposed between the first and second plate means and being frictionally maintained between the first and second plate means by the fastening means, pulley means disposed adjacent the side of the opening for guiding the first cord means and means for applying tension to the second cord means.

In a preferred embodiment, the sun blind also includes third stationary cord means disposed in the plurality of openings in the sun blinding means for guiding the sun blinding means and means for applying tension to the third cord means.

The sun blind of the present invention can include various embodiments of the tension applying means.

In a preferred embodiment, the sun blind of the present invention also includes fourth cord means for guiding the coupling means. Various embodiments of the first, second, third and fourth cord means are described.

Other objects, features and advantages of the present invention will be apparent from a reading of the detailed description below.

BRIEF DESCRIPTION OF THE DRAWINGS

The present invention will be described in greater detail in the following detailed description with reference to the drawings, in which:

FIG. 2D is a schematic drawing of another alternative form of the second cord arrangement;

FIG. 6 is a perspective view of the moving rail showing a duct-type tension lock for applying tension to the second cord arrangement which raises and lowers the sun blinding member;

FIG. 7 is a side view of the duct-type tension lock shown in FIG. 6;

FIG. 8 is a side perspective view of the first cord arrangement showing an alternative arrangement for the fourth cord arrangement which guides the coupler;

FIG. 9 is a detailed view of part of one embodiment of the fourth cord arrangement, showing a coupler for connecting the ends of the fourth cord arrangement together;

FIG. 10 is a cross sectional view of the fourth cord arrangement taken through the coupler shown in FIG. 9;

FIG. 15 shows an alternative embodiment of the first cord arrangement showing a single ring pull for operating the sunblind; and FIG. 16 shows yet another embodiment of the first cord arrangement showing a double ring pull for operating the sun blind;

DETAILED DESCRIPTION

Figure 1:
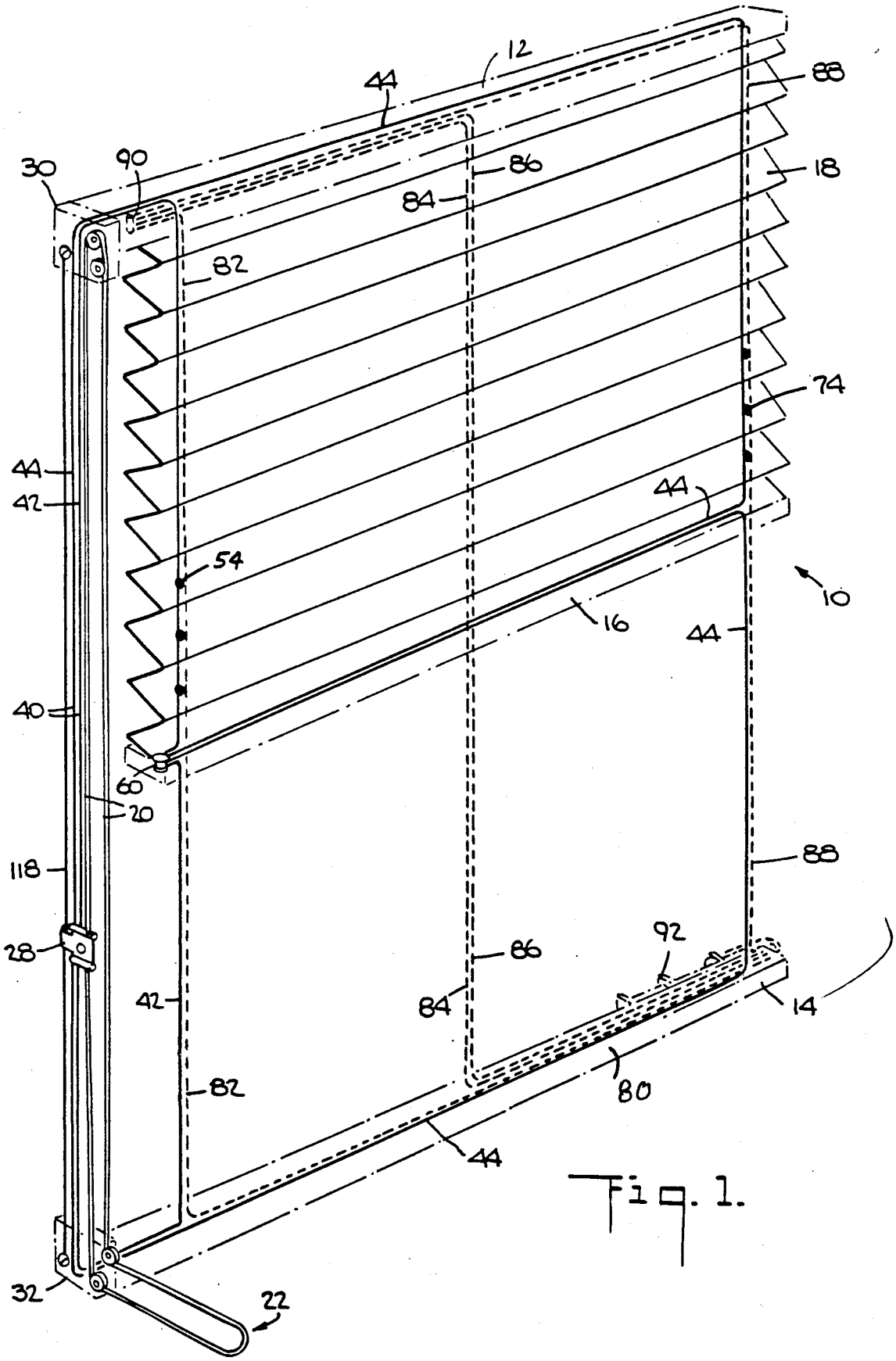
FIG. 1 is a perspective view of the sun blind according to the present invention.
Figure 2:
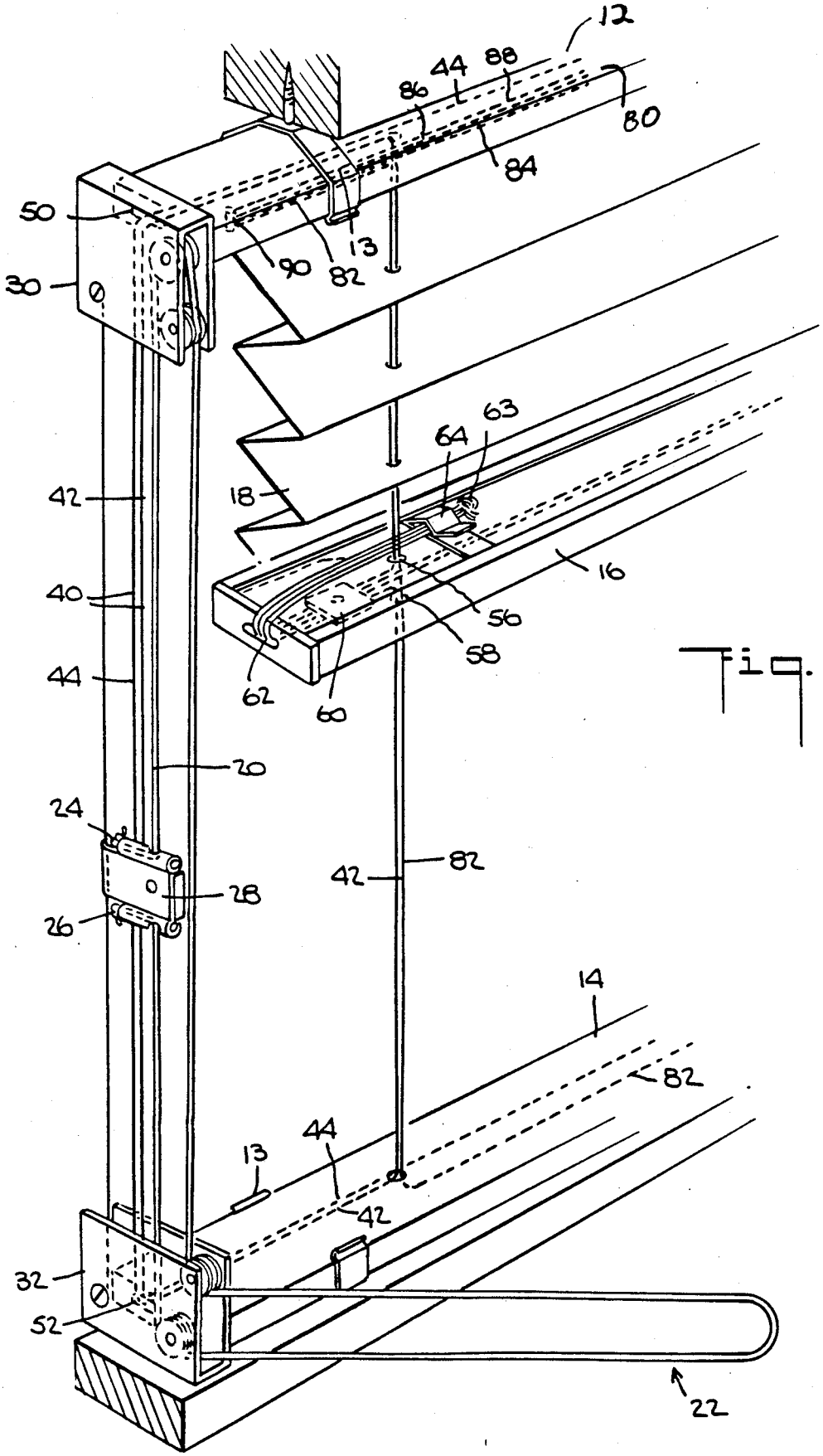
FIG. 2 is a detailed perspective view of a part of the sun blind show in FIG. 1.

With reference now to the drawings, and especially FIGS. 1 and 2, a sun blind according to the present invention is shown generally at 10. The sun blind includes a first or top rail 12 disposed adjacent the upper edge of a window opening, a second or lower rail 14 disposed adjacent the lower edge of the window opening and a third or moving rail 16 disposed between the first and second rails. A sun blinding member 18 is disposed between the first and third rails and connected to each of them. The sun blinding member may be pleated as shown, or could be made slatted, for example.

Upper and lower rails 12 and 14 may be attached to the upper and lower edges of the window opening by spring clips 13 as shown.

Furthermore, as used herein, the term "window opening" can also mean openings disposed at other than the vertical, for example, skylights in building roofs.

A first cord arrangement 20 is disposed adjacent a side of the window opening. The cord arrangement 20 may comprise one cord, as shown, having a loop 22 at the bottom of the opening which may be grasped by an operator. The two ends 24 and 26 of cord 20 may be knotted as shown and coupled together by a coupler 28 to form a loop extending around upper pulley assembly 30 and lower pulley assembly 32, as more clearly shown in FIG. 2.

Coupler 28 couples the first cord arrangement 20 to a second cord arrangement 40, to be described in more detail below, which traverses the top, lower and moving rails and the sun blinding member, and which allows the sun blinding member to be raised and lowered.

As shown, by grasping loop 22 in hand and by pulling either the upper or lower portion of the loop 22, coupler 28 can be made to move up or down alongside the window opening. As will be described in more detail below, this allows the moving rail 16, and thus the sun blinding member 18, to be raised or lowered.

Figure 2A:
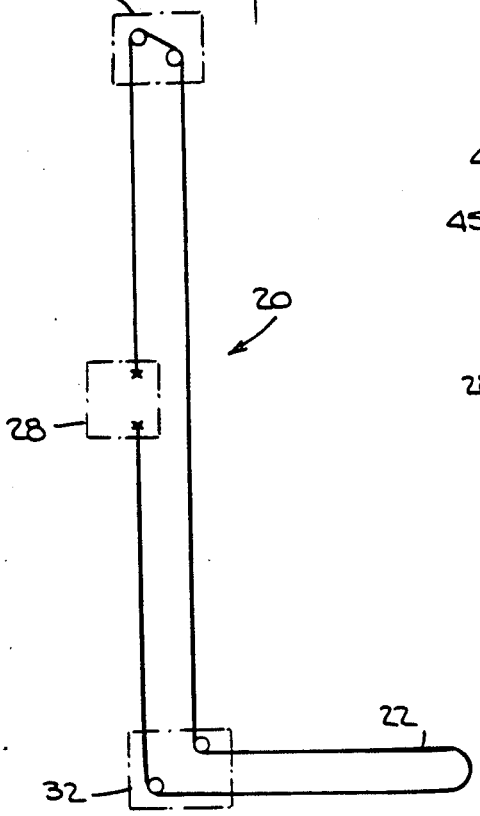
FIG. 2A is a schematic drawing of the first cord arrangement shown in FIGS. 1 and 2 and which may be grasped by an operator for moving the sun blind.

FIG. 2A is a schematic drawing of cord arrangement 20 of FIGS. 1 and 2 showing how it is threaded around pulleys 30 and 32. In FIG. 2A, as in all of the schematic drawings herein, an X indicates that the particular end of a cord is tied or knotted off. In FIG. 2A, the ends of cord 20 are tied off via coupler 28, as described above.

Second cord arrangement 40 may include a first cord 42 which extends alongside cord 20, enters the top and bottom rails 12 and 14 through holes 50 and 52, respectively, and exits from the top and bottom rails, travelling through a series of aligned openings 54 in the sun blinding member 18, ultimately entering the moving rail 16 as shown at 56 and 58. The two ends of cord 42 then traverse a duct-type tension lock 60, to be described in more detail below, may exit from the rail 16 at 62 and be tied off at 63. A small spring clamp 64, fastened to rail 16 and hidden beneath a pleat of the sun blinding member 18, may be provided to neatly secure the ends of the cords after the tension lock 60 is adjusted for the proper tension on cord 42. Alternatively, the cord ends simply can be tucked back into the hollow rail 16.

Cord arrangement 40 also includes a second cord 44 which traverses alongside cord 20, travels through the upper and lower rails 12 and 14 and through a second series of aligned openings 74 at the far side of the sun blinding member 18. Cord 44 similarly enters the moving rail 16, traverses its length and the two ends may be tied off at 63 along with the ends of cord 42. The two ends of cord 44 also are fed through tension lock 60. Alternatively, the ends of cord 44 may be tucked back into the rail 16.

Figure 2B:
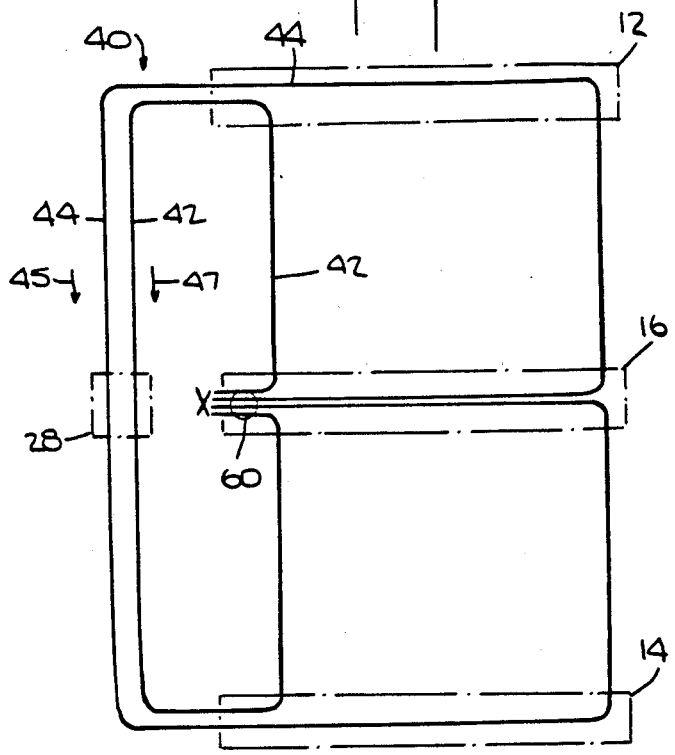
FIG. 2B is a schematic drawing of the second cord arrangement coupled to the moving rail of the sun blind which raises and lowers the sun blinding member.

FIG. 2B is a schematic drawing of cord arrangement 40. The circle in FIG. 2B indicates a tension lock, specifically, tension lock 60.

Figure 2C:
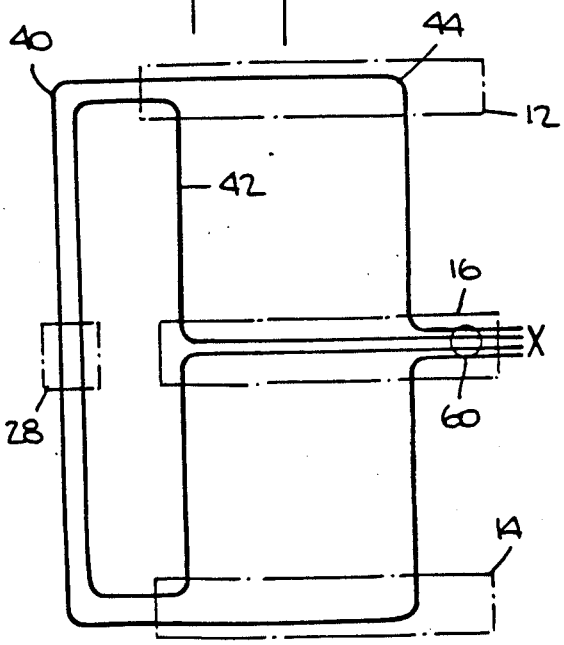
FIG. 2C is a schematic drawing of an alternative embodiment of the second cord arrangement.
Figure 2E:
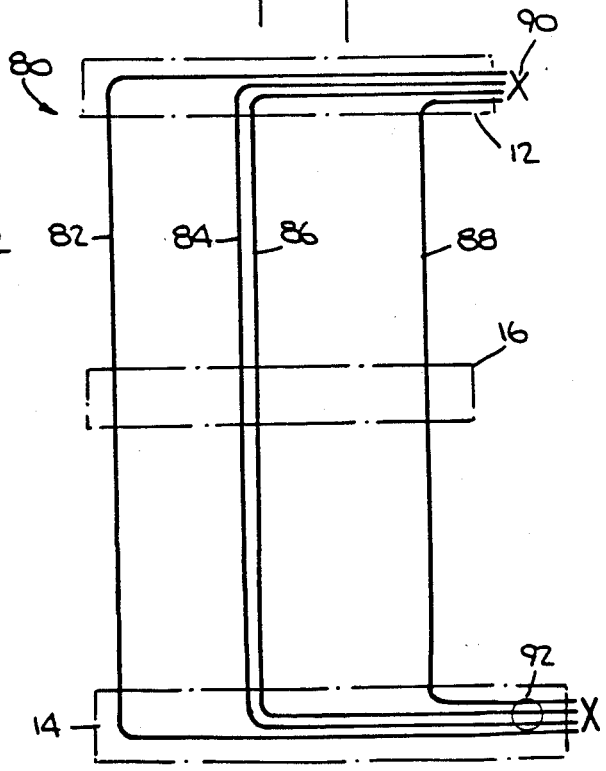
FIG. 2E is a schematic drawing of an embodiment of a a third cord arrangement for guiding the sun blinding member.

FIG. 2C is a schematic drawing of an alternate embodiment of second cord arrangement 40.

Figure 2F:
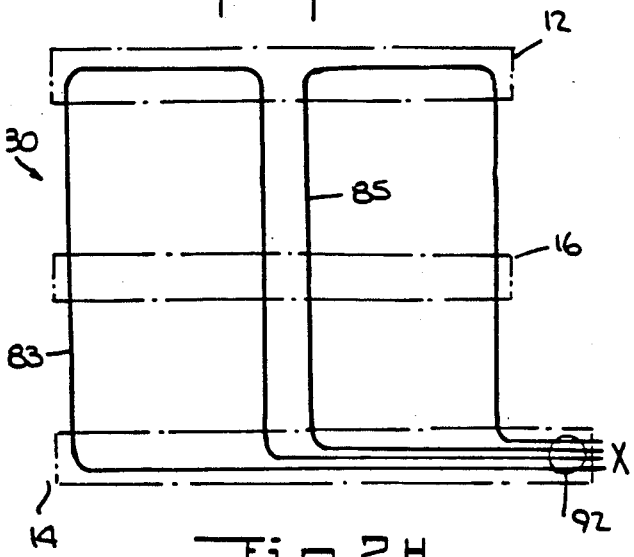
FIG. 2F is a schematic drawing of an alternative embodiment of the third cord arrangement.
Figure 2G:
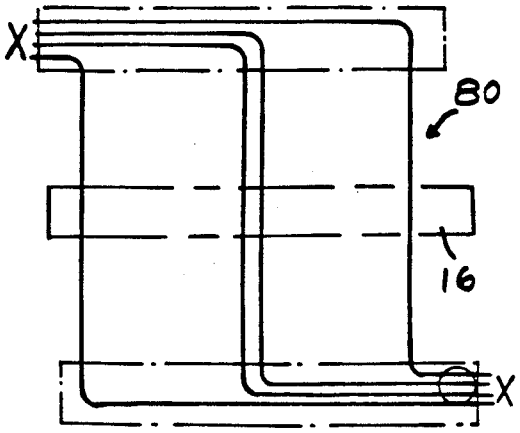
FIG. 2G is a schematic drawing of a preferred embodiment of the third cord arrangement and which is also shown in FIG. 1.
Figure 2H:
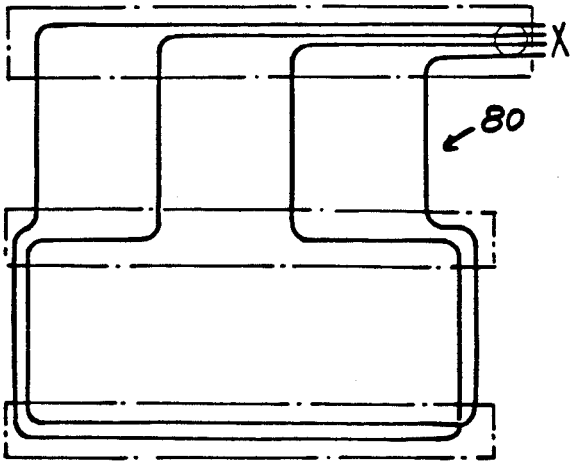
FIG. 2H is a schematic drawing of yet another embodiment of the third cord arrangement wherein the central cords are not visible when the blind is in the "up" position.
Figure 2I:
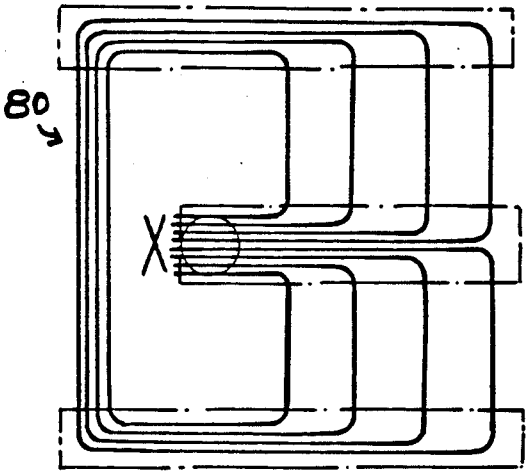
FIG. 2I is a schematic drawing of yet another embodiment of the third cord arrangement wherein the cords move with the sun blind.
Figure 2J:
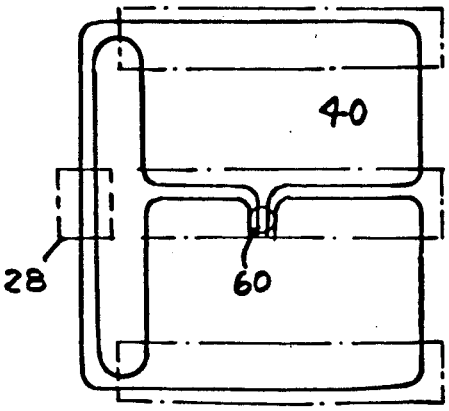
FIG. 2J is a schematic drawing of another embodiment of the second cord arrangement.

FIGS. 2D and 2J show other embodiments of cord arrangement 40. In FIG. 2J, a tension lock 60 is located in the center of moving rail 16.

Figure 2K:
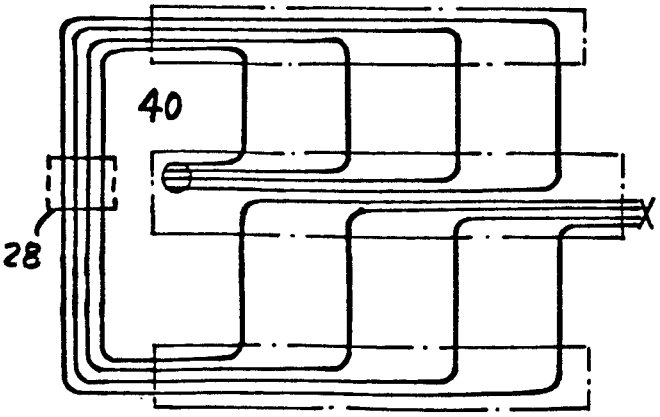
FIG. 2K is an embodiment of the second cord arrangement for larger sun blinds.

FIG. 2K shows an embodiment of cord arrangement 40 for wider sun blinds. In such a case, additional loops are utilized to properly guide the sun blind.

A third cord arrangement 80, shown in FIG. 1 and schematically shown in FIG. 2G, is also preferably provided. Cord arrangement 80 may include four cords 82, 84, 86 and 88 as shown, the ends of which are tied off at 90 and pass through a tension lock at 92. Cords 82, 84, 86 and 88 are shown by dotted lines in FIG. 1 and provide means for guiding sun blinding member 18 when it is raised and lowered. Tension lock 92 will be described in more detail below with reference to FIG. 5. The cords of cord arrangement 80 are typically of a small diameter but of relatively large tensile strength. This is necessary especially in skylight applications where the cords 80 also support the weight of the rail 16 and sun blinding member 18, in addition to guiding the sun blinding member.

Alternatively, cord arrangement 80 can also be constructed as shown in FIG. 2F, where it comprises two cords 83 and 85 looped as shown.

Other embodiments of cord arrangement 80 are shown in FIGS. 2E, 2G, 2H and 2I. The preferred arrangement is shown in FIG. 2G, because the cords are all the same length and this arrangement is the simplest to manufacture.

In FIGS. 2A through 2K, the spacings between parallel cord runs are not drawn to scale and may be highly exaggerated, in order that the cord arrangements be clearly shown.

In the following, the first cord arrangement 20 may be referred to as the "operating cord", the second cord arrangement 40 may be referred to as the "moving cord arrangement" and the third cord arrangement 80 may be referred to as the "stationary cord arrangement".

Figure 4:
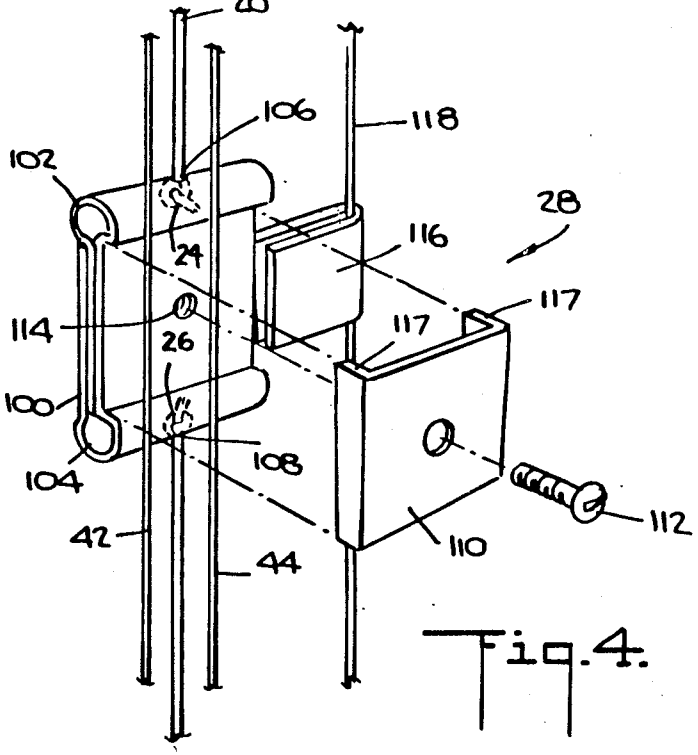
FIG. 4 is a detailed perspective view of an embodiment of the coupler which couples the first and second cord arrangements together.
Figure 4B:
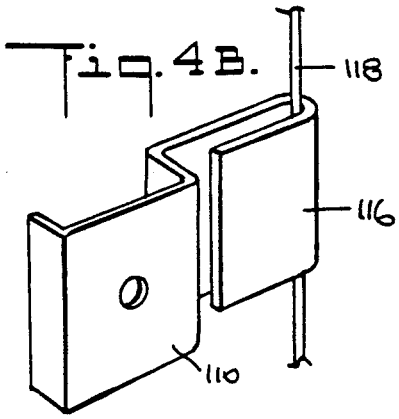
FIG. 4B is a perspective view of an alternative embodiment of part of the coupler.

Coupler 28 is shown in more detail in FIG. 4. Coupler 28 includes a first plate-shaped member or body 100, which might be made of pressed metal, for example. As shown, plate 100 may be a single piece of sheet metal, for example, folded over itself and having enlarged tubular ends 102 and 104. A cross sectional view through plate 100 is shown in FIG. 4A. Holes 106 and 108 are punched prior to forming or drilled into the tubular ends and the two ends of operating cord 20 are fed therethrough and tied off. The inside diameter of tubular ends 102 and 104 may be made just large enough so that the knots 24 and 26 of cord 20 are hidden from view inside the tubular ends and holes 106 and 108 are made small enough so that the knots cannot slip through. Alternatively, knots 24 and 26 can be as shown in FIG. 2. No tension need be applied to cord 20, although in certain embodiments, e.g., where a ring pull is used, tension may be provided.

Cords 42 and 44 of moving cord arrangement 40 are disposed adjacent plate 100. A second plate 110 is clamped to plate 100 with a screw 112 which engages a threaded hole 114 in plate 100, thereby clamping moving cord arrangement 40, which moves the sun blinding member, to operating cord 20, which allows a user to operate the sun blinding member via cord arrangement 40. Plate 110 may have two perpendicular extensions 117 along each side for helping to locate cords 42 and 44 between the plates 100 and 110. The tubular ends 102 and 104 of plate 100, which have a greater outside diameter than the thickness of plate 100 at its central point, provide an offset x in the cords 42 and 44 which increases the clamping force provided by coupler 28, as shown in FIG. 4A. Furthermore, the offset pushes the body of the coupler away from the moving rail 16 as well as providing a recess for screw head 112. Preferably, the tubular ends are squared off as shown at 103 to provide additional clamping force. Additionally, coupler 28 is made as thin as possible so as not to interfere with the movement of the sun blinding member 18.

As shown in the drawings, first plate member 100 may also include a folded-over extension 116. In an alternative embodiment, extension 116 may be provided as part of plate marked 110, as shown in FIG. 4B. An idler cord 118, which is disposed parallel to operating cord 20, is fed through the inner part of the fold of extension 116. Idler cord 118, also shown in FIGS. 1 and 2, may be fastened to the upper and lower pulley assemblies 30 and 32, and keeps coupler 28 from twisting and thus entangling the various cord arrangements.

Figure 4C:
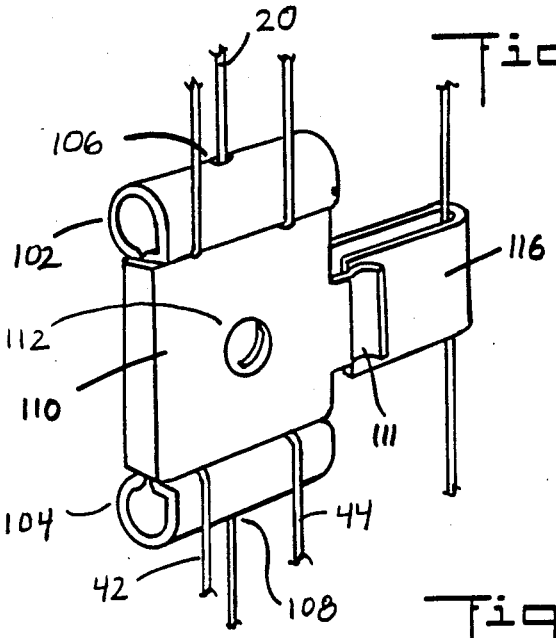
FIG. 4C is a perspective view of yet another alternative embodiment of the coupler.
Figure 4A:
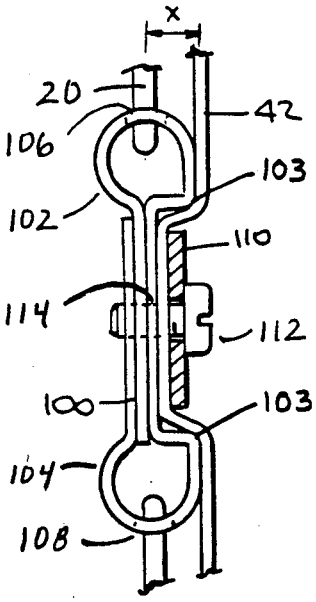
FIG. 4A is a cross sectional view through a part of the coupler in FIG. 4.

FIG. 4C shows another embodiment of coupler 28. In this embodiment, extension 116 is part of plate 100, as in FIG. 4, and plate 110 includes a tab 111 to prevent cord 118 from slipping out but which allows the cord to be initially slipped through easily.

In operation, when the loop 22 of operating cord 20 is grasped by a user and a side of the loop is pulled, coupler 28 will move either up or down, depending on which side of loop 22 is pulled. Cords 42 and 44 of moving cord arrangement 40 will therefore move with coupler 28, causing the moving rail 16, and thus the sun blinding member 18, to move up or down as desired.

An advantage of this arrangement is that the sun blind can be adjusted for slightly out of square windows. By pulling one of the cords 42 and 44 relative to the other, the angle of moving rail 16 to the horizontal may be adjusted. For example, as shown in FIG. 2B, if cord 44 is moved in the direction of arrow 45 while cord 42 is held motionless or moved in the opposite direction, the right end of moving rail 16 can be made to rise to accommodate a window jamb which slopes upward from left to right. The same effect can be obtained by lowering the left end of rail 16 by pulling on cord 42 in the direction opposite arrow 47. Similarly, to raise the left end of rail 16, cord 42 can be moved downward in the direction of arrow 47. Obviously, this has the same effect as moving cord 44 upwards, in the direction opposite arrow 45.

The use of cord arrangement 40 having at least two separate loops as shown, each controlling one side of moving rail 16, allows for simple adjustment of the coupler. This arrangement is contrary to the generally used arrangement wherein the cords are crossed-over for better symmetry and stability.

Another advantage of this arrangement is that completely separate cord arrangements 20, 40 and 80 are used, one of which is grasped by an operator, another of which moves the sun blinding member 18, and another of which guides the sun blind.

This arrangement provides several benefits. For one, operating cord 20 preferably is not under tension. Cord arrangement 40, however, is under some tension and cord arrangement 80 is under even more tension. Because the friction created by tense cords accounts for a large part of the force required to operate a sun blind and because operating cord 20 is not under such tension and cord arrangement 80 is not used to move the sun blind, the effort required to operate the sun blind is reduced.

Furthermore, the described arrangement provides a convenient way to install sun blinds in window openings. Pulley assemblies 30 and 32 can first be installed in the window opening independently of the sun blind proper. The sun blind can then be installed and cords 42 and 44 clamped to cord 20 via coupler 28. Of course, pulley assemblies 30 and 32 can be installed directly on the rails 12 and 14, in which case they may be made as rail end caps having extensions which insert directly into the ends of hollow rails 12 and 14. Alternatively, they can be fastened to rails 12 and 14 with appropriate fasteners.

Figure 3:
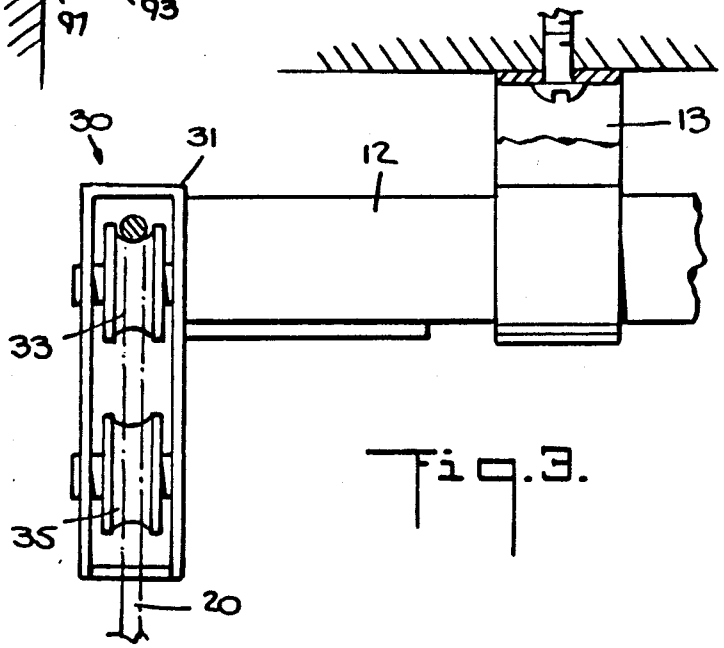
FIG. 3 is a detailed front view of the upper pulley arrangement.

FIG. 3 is an end view of upper pulley assembly 30. Lower pulley assembly 32 is similar to upper assembly 30, except that it is disposed upside down, i.e., it may be a mirror image of the upper pulley assembly.

Pulley assemblies 30 and 32 include a thin generally rectangular frame 31. Pulleys 33 and 35 are disposed on axles drilled through frame 31. In the upper pulley assembly, only one pulley need be used, although in FIGS. 1 and 2, both are shown being used. In the lower assembly 32, both pulleys are ordinarily used. Both pulley assemblies, however, are identical to ease production, decrease manufacturing costs and simplify adjustments.

Figure 5:
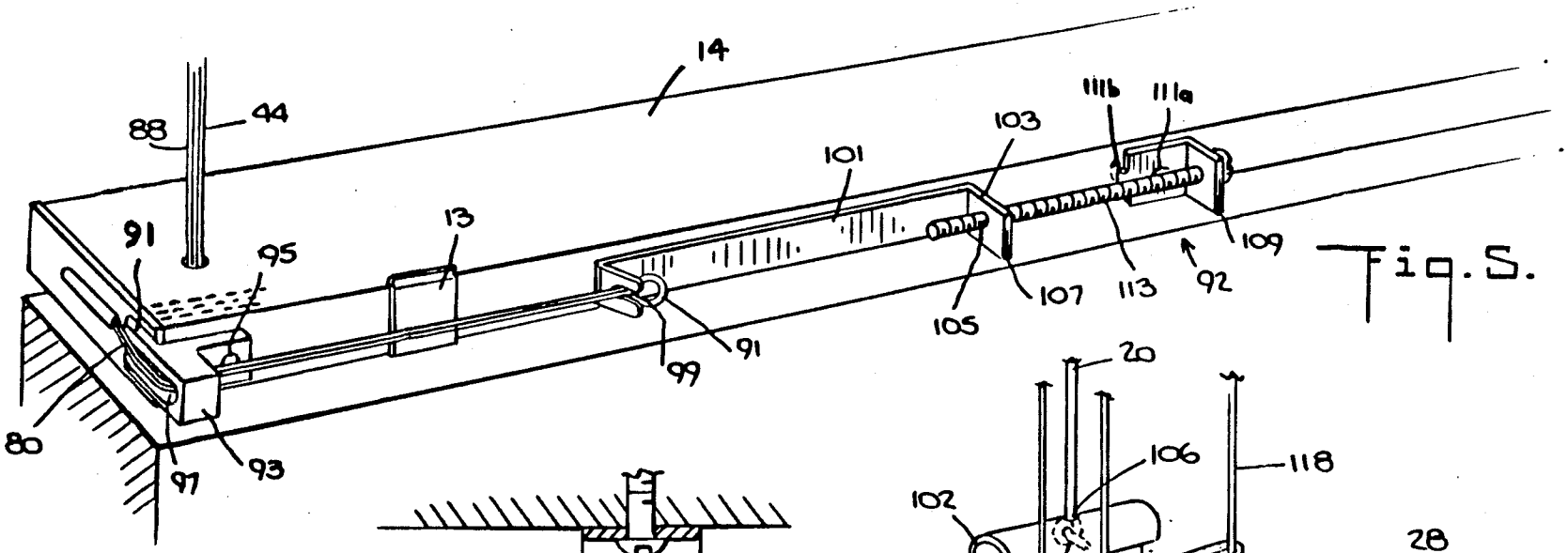
FIG. 5 is a perspective view of a part of the lower rail showing the tension lock for applying tension to the third cord arrangement which guides the sun blinding member.
Figure 5A:
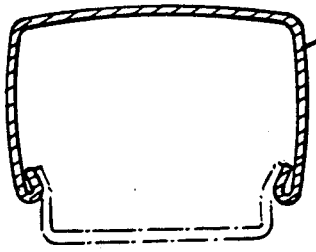
FIG. 5A shows a cross sectional view of a cover for the tension lock of FIG. 5.
Figure 1B:
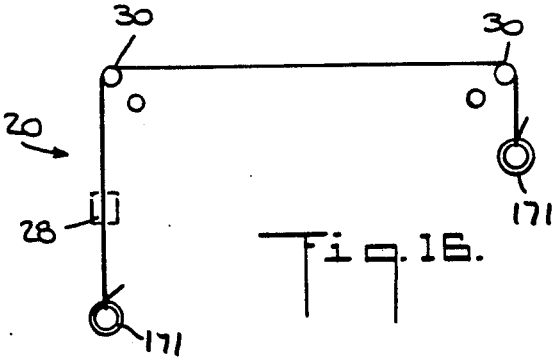
Figure 1S:
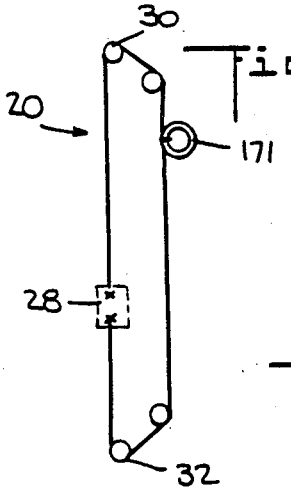

FIG. 5 illustrates one embodiment of tension lock 92 used to apply tension to stationary cord arrangement 80. Tension lock 92 is preferably disposed along the rear edge of lower rail 14, so that it is hidden from view. Tension lock 92 includes a right angle guide 93 which may be riveted, screwed or adhesively fastened to rail 14, and which may be molded from plastic. In FIG. 5, a screw or rivet is shown at 95. Cords 80 are routed through a hole 97 in guide 93. Guide 93 includes a first portion 91 which extends over the end of rail 14 so as to guide cords 80. Cords 80 are knotted and passed through a slot 99 in one end of a formed coupling piece 101, which end may be at an angle from the body of coupling piece 101. Gross adjustments are made by making a knot in the cords, as required. The cords 80 may be knotted around a ring 91, as shown, to tie cords 80 off. At the other end of coupling piece 101, a right angle 103 is formed to form a leg 107. A threaded hole 105 is provided in the leg 107. An anchor piece 109 is fastened to lower rail 14 with screws or rivets as shown at 111*a* and preferably using a tab 111*b* extending into a hole in rail 14. Alternately, a strong adhesive could also be used. A screw 113 is passed through an aperture in anchor 109 and threaded into hole 105 in leg 107. To adjust the tension on cords 80, the screw 113 is turned. In order to hide tension lock 92 from view, a snap or slide on cover 115 may be provided which is guided by members 93 and 109. The cover for tension lock 92 is shown in cross sectional view in FIG. 5A.

A smaller tension lock is used to apply tension to moving cords 40. Because moving cords 40 are provided with less tension than stationary cords 80, a smaller tension lock 60 is provided for these cords. This tension lock is shown in greater detail in FIGS. 6 and 7 and is typically disposed in one end of moving rail 16 and called a duct type tension lock. Tension lock 60 may be constructed integrally with the end cap 120 of rail 16. End cap 120 includes a duct 122 for the various cords 40 and is constructed so that it slides snugly into hollow rail 16. An extension 124 of the end cap is provided which serves as a first clamping surface. A second clamping surface is provided by plate 126. Rail 16 is provided with a hole 128 through which the head of a screw 130 is passed. A smaller hole is also provided in extension 124. Plate 126 is provided with a threaded hole 132 for engaging screw 130. Cords 40 are passed between plate 126 and extension 124. At the same time that tension is applied to the cords 40, a screwdriver is used to clamp the plate 126 and extension 124 together, thus locking cords 40. The ends of cords 40 pass through duct 122 and may be tied off as shown in FIG. 2. A clamp 64 hidden by the pleats of sun blinding member 18 may be used to keep cords 40 from appearing unsightly or interfering with operation. Alternatively, the cords may be tucked back into the rail.

Tension locks 92 and 60 allow the installer of the sun blind to accommodate windows of varying size. Once the sun blind is installed, the extra length of cord is cut and tied off.

FIGS. 8, 9 and 10 show an alternative and preferred arrangement for idler cord 118. As shown in FIG. 8, idler cord 118 is provided in a loop, the ends of which are connected together by a coupler 140. Coupler 140 may include an elongated tapered ring 142 and a sleeve 144 which fits snugly over the ring 142. The sleeve also may be tapered. The upper end of cord 118 is tied to ring 142. The lower end is passed through and wrapped around the ring as shown in FIGS. 9 and 10. Sleeve 144 is then passed over the ring 142, pinching the cord 118 between the sleeve and ring as shown at 146 in FIG. 10. To increase tension on idler cord 118, the free end 148 is pulled downward. This arrangement provides a convenient way of installing the idler cord, since it is often difficult to reach the tight areas near the pulley assemblies 30 and 32 to tie the ends of cord 118 off. With this arrangement, the cord 118 is simply passed over posts 150 and 152 and tightening of cord 118 is done afterwards in the more accessible areas in the vicinity of coupler 28.

Figure 10A:
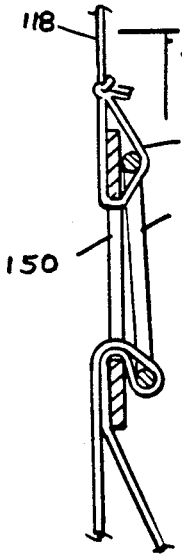
FIG. 10A shows an alternative embodiment for the coupler for the fourth cord arrangement.

Another coupler for idler cord 118 is shown in FIG. 10A. In this arrangement one end of cord 118 is tied to two washers 150 and 152 as shown at 154. The other end is passed through the washer 150 and around washer 152 and is held in position by friction once cord 118 is tightened.

FIGS. 11, 12, 13 and 14 illustrate how the sun blind may be installed in a building skylight 160. A ring assembly 170 which is accessed by a hooked rod 172 having a hook at one end may be provided for moving the sun blinding member 18 if a long looped cord hanging from the sun blind is undesirable. One example of such a ring assembly 170 is shown in greater detail in FIG. 12. Cord 20 is passed through a ring 171 and around two threaded posts 173 in a first plate member 175, as shown. A second plate member 177 is clamped to the first plate member 175 by screws 179 which are received by the threaded posts 173. Plate members 175 and 177 may be made to interlock if plate member 175 is formed as a channel as shown. In any event, the total width of plates 175 and 177 when assembled should be such that they may pass over the pulleys of the pulley assemblies without interfering with smooth operation.

Figure 13:
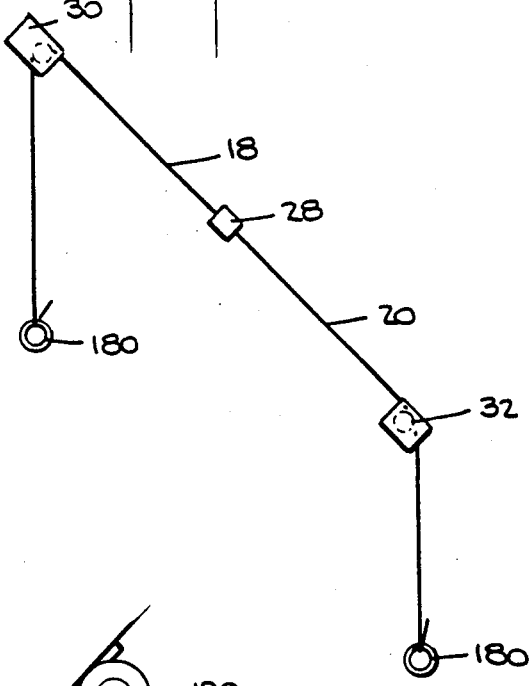
FIG. 13 shows another means for operating the sun blind of the present invention installed in a skylight.

FIG. 13 shown an alternative embodiment of the cord arrangement 20 in a skylight blind. Ends of cord 20 are coupled to rings 180 which can be moved by hooked rod 172.

Figure 14A:
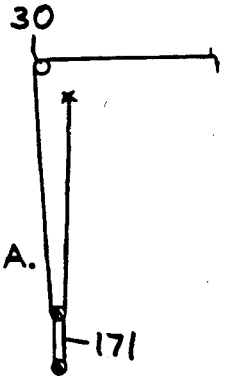
FIG. 14A shows an embodiment of the first cord arrangement having a ring pull for operating the sun blind which allows the sun blind to move twice the distance that the ring moves.
Figure 14B:
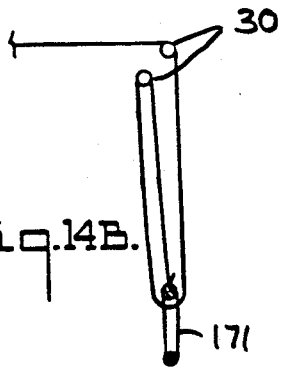
FIG. 14B shows an embodiment of the first cord arrangement having a ring pull for operating the sun blind which allows the sun blind to move three times the distance that the ring moves.
Figure 11:
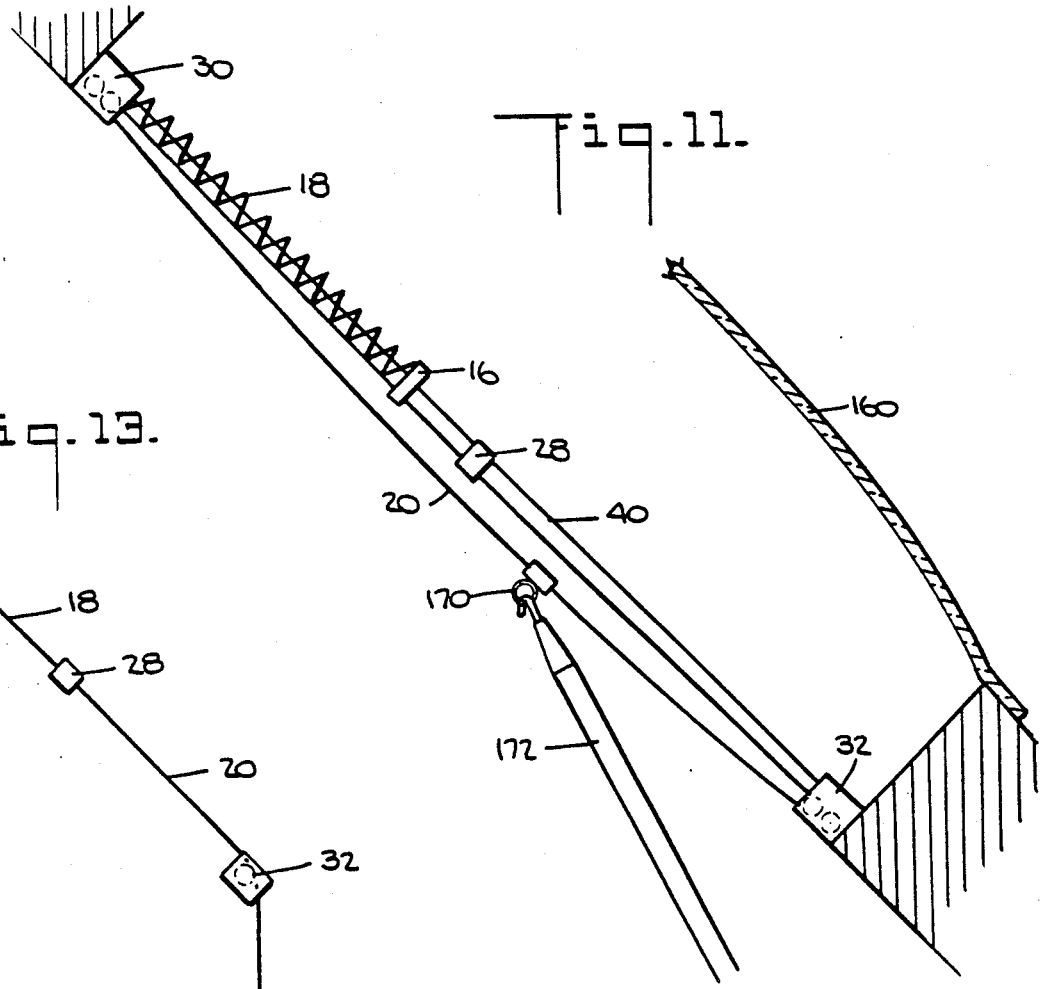
FIG. 11 is a side view of the sun blind of the present invention installed as a skylight in a building roof.
Figure 14:
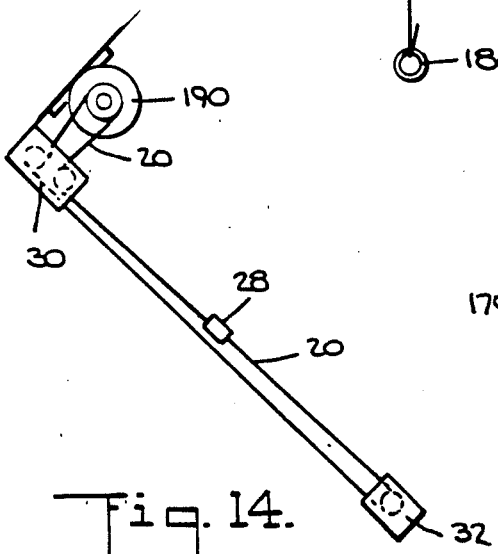
FIG. 14 is a side view of a motorized embodiment of the sun blind disposed in a skylight showing how a motor can be arranged to operate the first cord arrangement.
Figure 12:
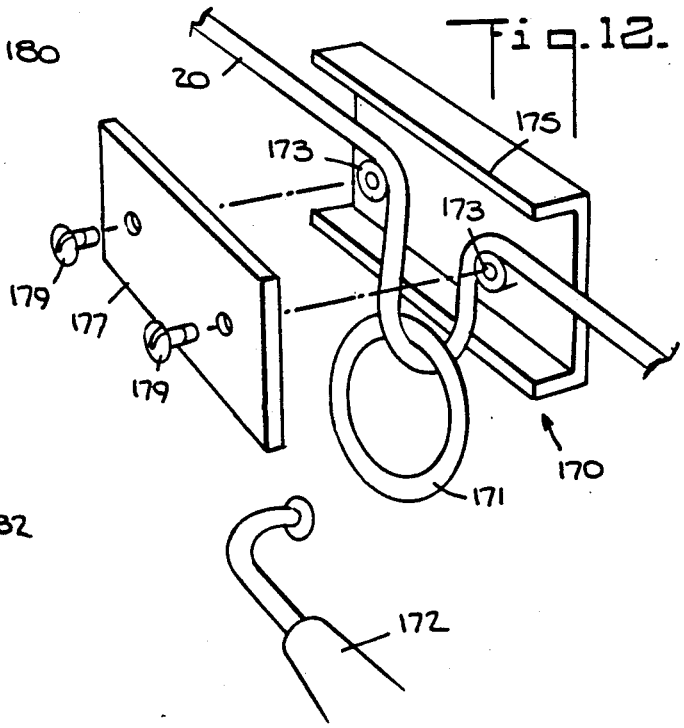
FIG. 12 is a detailed perspective view of one means for allowing an operator to move the sun blinding member installed in a skylight.

FIG. 14 illustrates a motorized embodiment. Cord 20 is disposed around a pulley assembly 30 and wrapped around a jack shaft coupled to a motor or the shaft of a reversible electric motor 190.

FIG. 15 shows an alternative embodiment for first cord arrangement 20 wherein a single ring 171 is attached to cord 20 for moving the sun blind. In FIG. 16 an arrangement is shown wherein two rings, one on each side of the sun blind, are used.

FIG. 14A shows an arrangement wherein a ring 171 may be pulled half as far as the movement transfered to the sun blind, and FIG. 14B shows an arrangement wherein ring 171 may be pulled one-third as far as the movement transfered to the sun blind. In FIGS. 14A and 14B, pulleys are denoted at 30.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. A sun blind for a window opening comprising:

first rail means disposed adjacent the top of the opening;

second rail means disposed adjacent the bottom of the opening;

third rail means disposed between the first and second rail means, the third rail means being movable between the first and second rail means;

sun blinding means disposed between the first and third rail means and attached to the first and third rail means, the sun blinding means having a plurality of aligned apertures disposed therein;

first cord means disposed adjacent a side of the opening and being operable by an operator;

second cord means at least partially disposed adjacent the first cord means and further being disposed in the plurality of aligned openings in the sun blinding means for moving the third rail means in a direction perpendicular to a longitudinal direction of the third rail means;

means disposed on the first cord means adjacent the side of the window for adjustably coupling the first cord means to the second cord means, the coupling means including first and second plate means and means for releasably fastening the first plate means to the second plate means, the second cord means being disposed between the first and second plate means and being frictionally maintained between the first and second plate means by the fastening means, said coupling means allowing said second cord means to be adjusted with respect to said first cord means, whereby the longitudinal orientation of said third rail means with respect to a longitudinal orientation of said second rail means may be adjusted;

means disposed adjacent the side of the opening for guiding the first cord means; and means for applying tension to the second cord means.

2. The sun blind recited in claim 1, further comprising third cord means for guiding said sun blinding means when said sun blinding means is moved, said third cord means being disposed in said plurality of aligned apertures in said sun blinding means.

3. The sun blind recited in claim 2, further comprising means disposed adjacent the side of the window for holding said coupling means in a fixed orientation when said coupling means is moved.

4. The sun blind recited in claim 3 wherein said holding means comprises fourth cord means and said means for guiding the first cord means comprises pulley means.

5. The sun blind recited in claim 4 wherein said coupling means further comprises extension means having a loop, said fourth cord means disposed through said loop.

6. The sun blind recited in claim 4 wherein said fourth cord means comprises a looped cord extending between a first point near the top of said opening and a second point near the bottom of said opening, said fourth cord means having first and second ends, said ends being coupled together by second coupling means.

7. The sun blind recited in claim 6 wherein said second coupling means comprises ring means, one of said first and second ends being tied to said ring means, the other of said ends being passed through said ring means, and sleeve means disposed around said ring means for frictionally engaging said other end of said fourth cord means.

8. The sun blind recited in claim 7 wherein said ring means is shaped so as to have a taper.

9. The sun blind recited in claim 6 wherein said second coupling means comprises first and second ring means, one end of said fourth cord means being passed through both said ring means and tied off, the other end of said fourth cord means being passed through said two ring means and being frictionally held between said two ring means.

10. The sun blind recited in claim 1 wherein said first plate means of said coupling means further includes elongated substantially tubular sections extending along the top and bottom edges of said first plate means, said tubular sections each having a hole near the longitudinal midpoint thereof for receiving said first cord means, said first cord means being passed through said tubular sections, the tubular sections having an inside diameter which is large enough to receive a knot of said first cord means therein so as to secure said first cord means to said first plate means, said hole being smaller than said knot so as to prevent the knot from slipping therethrough.

11. The sun blind recited in claim 10 wherein said second plate means of said coupling means comprises a plate having a dimension such that it fits between the tubular sections extending along the top and bottom edges of said first plate means.

12. The sun blind recited in claim 11 wherein said tubular sections have an outside diameter, the outside diameter being greater than the thickness of said first plate means near the center thereof so that when said second cord means is clamped between said first and second plate means, said second cord means is offset.

13. The sun blind recited in claim 12 wherein said fastening means of said coupling means comprises screw means.

14. The sun blind recited in claim 11 wherein said second plate means includes perpendicular extensions for locating said second cord means between said first and second plate means.

15. The sun blind recited in claim 1 wherein said tension applying means comprises third plate means, fourth plate means and fastening means for clamping said third and fourth plate means together, said second cord means being disposed between said third and fourth plate means.

16. The sun blind recited in claim 15 wherein said first, second and third rail means each comprise a hollow rectangular elongated member, said rail means having an end cap which fits into said hollow rectangular member and wherein one of said third and fourth plate means comprises an extension of said end cap.

17. The sun blind recited in claim 16 wherein said end cap includes a duct through which ends of said second cord means are passed.

18. The sun blind recited in claim 2, further comprising second means for applying tension to said third cord means.

19. The sun blind recited in claim 18 wherein said second tension applying means comprises first bracket means having first and second legs forming a substantially right angle between them, said first leg being fastened to one of said rail means, the second leg having an aperture therethrough for receiving said third cord means, second bracket means having first and second legs forming a substantially right angle between them, said first leg of said second bracket means being fastened to the same one of said rail means as said first bracket means and being spaced apart from said first bracket means, the second leg of said second bracket means having an aperture therein, screw means disposed in said aperture in said second bracket means, and coupling member means disposed between said first and second bracket means engaging said screw means and fastened to said third cord means.

20. The sun blind recited in claim 1 further comprising motor means for moving said first cord means.

21. The sun blind recited in claim 1 further comprising ring means fastened to said first cord means, said ring means being engageable by an operator for moving said first cord means.

22. The sun blind recited in claim 1 wherein said means for guiding the first cord means comprises pulley means disposed adjacent the side of said opening at an end of said first rail means and at an end of said second rail means, said first and second pulley means being detachable from said rail means.

23. The sun blind recited in claim 22 wherein said first and second pulley means comprises an end cap of the respective rail means.

24. The sun blind recited in claim 22 wherein each of said first and second pulley means identically comprise a thin substantially rectangular frame, said frame having at least one pulley assembly disposed therein.

25. The sun blind recited in claim 24 wherein each of said frames has two pulley assemblies disposed therein and arranged to allow a plurality of different cord arrangements of said first cord means through said pulley assemblies.

26. The sun blind recited in claim 1, wherein said second cord means comprises first and second cords, said first cord coupled to a first end of said third rail means, the second cord being in contact with a second end of said third rail means, said coupling means allowing said first and second cords to be adjusted with respect to each other, whereby the longitudinal orientation of said third rail means may be adjusted.

27. A sun blind for a window opening comprising:

first rail means disposed adjacent the top of the opening;

second rail means disposed adjacent the bottom of the opening;

third rail means disposed between the first and second rail means, the third rail means being movable between the first and second rail means;

sun blinding means disposed between the first and third rail means and attached to the first and third rail means, the sun blinding means having a plurality of aligned apertures disposed therein;

first cord means disposed adjacent a side of the opening and being operable by an operator;

second cord means at least partially disposed adjacent the first cord means and further being disposed in the plurality of aligned openings in the sun blinding means for moving the third rail means in a direction perpendicular to a longitudinal direction of the third rail means;

means disposed on the first cord means adjacent the side of the window for adjustably coupling the first cord means to the second cord means, the coupling means including first and second plate means and means for releasably fastening the first plate means to the second plate means, the second cord means being disposed between the first and second plate means and being frictionally maintained between the first and second plate means by the fastening means said coupling means allowing said second cord means to be adjusted with respect to said first cord means, whereby the longitudinal orientation of said third rail means with respect to a longitudinal orientation of said second rail means may be adjusted;

means comprising pulley means disposed adjacent the side of the opening for guiding the first cord means;

means for applying tension to the second cord means;

third cord means for guiding said sun blinding means when said sun blinding means is moved, said third cord means being disposed in said plurality of aligned apertures in said sun blinding means; and fourth cord means disposed adjacent the side of the window for holding said coupling means in a fixed orientation when said coupling means is moved.

28. The sun blind recited in claim 25 wherein said coupling means further comprises extension means having a loop, said fourth cord means disposed through said loop.

29. The sun blind recited in claim 25 wherein said fourth cord means comprises a looped cord extending between a first point near the top of said opening and a second point near the bottom of said opening, said fourth cord means having first and second ends, said ends being coupled together by second coupling means.

30. The sun blind recited in claim 27 wherein said second coupling means comprises ring means, one of said first and second ends being tied to said ring means, the other of said ends being passed through said ring means, and sleeve means disposed around said ring means for frictionally engaging said other end of said fourth cord means.

31. The sun blind recited in claim 28 wherein said ring means is shaped so as to have a taper.

32. The sun blind recited in claim 27 wherein said second coupling means comprises first and second ring means, one end of said fourth cord means being passed through both said ring means and tied off, the other end of said fourth cord means being passed through said two ring means and being frictionally held between said two ring means.

33. A sun blind for a window opening comprising:

first rail means disposed adjacent the top of the opening;

second rail means disposed adjacent the bottom of the opening;

third rail means disposed between the first and second rail means, the third rail means being movable between the first and second rail means;

sun blinding means disposed between the first and third rail means and attached to the first and third rail means, the sun blinding means having a plurality of aligned apertures disposed therein;

first cord means disposed adjacent a side of the opening and being operable by an operator;

second cord means at least partially disposed adjacent the first cord means and further being disposed in the plurality of aligned openings in the sun blinding means for moving the third rail means in a direction perpendicular to a longitudinal direction of the third rail means;

means disposed on the first cord means adjacent the side of the window for adjustably coupling the first cord means to the second cord means, the coupling means including first and second plate means and means for releasably fastening the first plate means to the second plate means, the second cord means being disposed between the first and second plate means and being frictionally maintained between the first and second plate means by the fastening means said coupling means allowing said second cord means to be adjusted with respect to said first cord means, whereby the longitudinal orientation of said third rail means with respect to a longitudinal orientation of said second rail means may be adjusted;

means disposed adjacent the side of the opening for guiding the first cord means;

means for applying tension to the second cord means;

third cord means for guiding said sun blinding means when said sun blinding means is moved, said third cord means being disposed in said plurality of aligned apertures in said sun blinding means; and second means for applying tension to said third cord means.

34. The sun blind recited in claim 31 wherein said second tension applying means comprises first bracket means having first and second legs forming a substantially right angle between them, said first leg being fastened to one of said rail means, the second leg having an aperture therethrough for receiving said third cord means, second bracket means having first and second legs forming a substantially right angle between them, said first leg of said second bracket means being fastened to the same one of said rail means as said first bracket means and being spaced apart from said first bracket means, the second leg of said second bracket means having an aperture therein, screw means disposed in said aperture in said second bracket means, and coupling member means disposed between said first and second bracket means engaging said screw means and fastened to said third cord means.

* * * * *